United States Patent [19]

Yuan

[11] Patent Number: 4,648,415

[45] Date of Patent: Mar. 10, 1987

[54] NAIL CLIPPER AND RETAINER AND DISPOSER OF NAIL CLIPPINGS

[76] Inventor: James J. Yuan, 222 W. 22nd Pl., Apt. 2-A, Chicago, Ill. 60616

[21] Appl. No.: 640,162

[22] Filed: Aug. 13, 1984

Related U.S. Application Data

[63] Continuation-in-part of Ser. No. 585,264, Mar. 1, 1984, abandoned.

[51] Int. Cl.[4] ..... A45D 29/00

[52] U.S. Cl. ..... 132/73; 30/28

[58] Field of Search ..... 132/73, 73.5, 75.4, 132/75.5, 75.6, 76.2; 30/28

[56] References Cited

U.S. PATENT DOCUMENTS

| | | | |
|---|---|---|---|
| 2,521,027 | 9/1950 | Sorensen | 132/75.4 |
| 2,837,821 | 6/1958 | David | 30/28 |
| 2,995,820 | 8/1961 | Pocoski | 30/28 |
| 3,013,334 | 12/1961 | Bassett | 30/28 |
| 3,031,754 | 5/1962 | Pocoski | 30/28 |
| 3,154,850 | 11/1964 | Okuno | 132/73 |
| 3,169,312 | 2/1965 | Fink | 30/28 |
| 3,180,025 | 4/1965 | Tsunemi | 132/73 |
| 3,188,737 | 6/1965 | Chase | 132/73 |
| 3,316,632 | 5/1967 | Bowers | 30/28 |
| 3,943,948 | 3/1976 | Satore | 132/73 |
| 3,986,257 | 10/1976 | Kiura | 132/73 |
| 3,997,966 | 12/1976 | Satore | 30/28 |
| 4,017,923 | 4/1977 | Schantz | 132/73 |
| 4,150,481 | 4/1979 | Min | 132/79 |
| 4,196,514 | 4/1980 | Merriman | 30/28 |
| 4,380,120 | 4/1983 | Hannon | 30/28 |

*Primary Examiner*—Gene Mancene
*Assistant Examiner*—Cary E. Stone
*Attorney, Agent, or Firm*—Hill, Van Santen, Steadman & Simpson

[57] ABSTRACT

Nail clipper of the leaf spring type in which the leaf spring elements of the clipper are superimposed and have facing inturned cutting edges at their proximate ends and are riveted together at their distal ends. A post extending through the leaf spring elements close to the proximate ends thereof forms a reaction member for a lever moving the leaf spring elements together to effect a clipping operation. Extending partially about the post and facing the cutting edges of the leaf spring elements is a nail clipping decelerator and accumulator formed to prevent the flying of nail clippings beyond opposite edges of the clipper and to accumulate the clippings for disposal by opening the clipper and shaking it in a sideways direction. The clippings decelerator and accumulator has arcuate faces extending from opposite sides of the post and cooperating with a recessed arcuate face of the post and also has closed sides extending from the arcuate faces toward the clipping edges of the clipper and has a ledge extending along the tops of the arcuate faces as well as a similar ledge engaging the bottom of the lowermost leaf spring element, to decelerate and accumulate the clippings for the entire width of the lowermost leaf spring element until necessary to dispose of the clippings by opening the clipper blades and shaking the clipper from side to side, with the decelerator and accumulator facing in a downward direction.

12 Claims, 6 Drawing Figures

NAIL CLIPPER AND RETAINER AND DISPOSER OF NAIL CLIPPINGS

This application is a continuation-in-part of my application Ser. No. 585,264, filed Mar. 1, 1984 and now abandoned.

BACKGROUND OF THE INVENTION

Nail-clipping devices in which the clippings are intended to be retained to the device and held from scattering during clipping of the fingernails or toenails, and collected for disposal, have heretofore been known. Such nail clippers of the type fitting in the pocket or purse usually utilize two superimposed spring steel elements riveted together at their distal ends and having inturned sharpened cutting edges at their opposite ends in which the steel elements are biased apart when riveted together, with the top element extending from the rivet angularly away from the bottom element, to bias the cutting edges of the elements away from each other at the proximate ends of the spring steel elements, to enable the fingernail or toenail to be placed along the lower sharpened cutting edge and be trimmed as said cutting edges are brought together. Such clippers have also had retaining means for the clipped nails which extend along the top and lower spring steel elements toward a point where the spring steel elements come together. While such clippings retainers and collectors may prevent scattering of the nail fragments, they materially add to the cost and bulk of the clipper and are objectionable in that the clippings frequently fly out the sides of the clipper and when this does not happen the user of the clipper frequently lets the clippings accumulate in the clipper rendering it difficult to clip the nails when the retainer is filled with clippings.

While the efficiency of clipping can be increased upon emptying the clippings from the retainer, it is usually difficult to thoroughly clean the retainer of nail clippings, particularly when the nail clippings are not clean and the oil of the dirty nails causes the clippings to adhere to the retainer and clipper, and thereby adds to the build-up of nail clippings in a next succeeding clipping operation.

SUMMARY, ADVANTAGES AND OBJECTS OF THE INVENTION

The present invention overcomes the disadvantages heretofore present in nail clippers which are constructed to retain the clippings to the clipper during a nail clipping operation by utilizing two superimposed flat flexible spring steel elements riveted together at their distal ends, and having cooperating facing cutting edges at their proximate ends, biased apart to accommodate insertion of the nails therebetween for clipping, in which a post extends through said leaf spring elements close to the proximate ends of the spring elements and a lever reacts against the post and is fulcrumed to bring the cutting edges of the leaf spring elements together and effect a nail trimming and clippings collecting operation.

The collecting element for the nail trimmings also extends laterally of the post to opposite sides of the leaf spring elements and has deflecting faces cooperating with an arcuate recessed face of the post and relatively close to the cutting edges of the clipper to cause a continuous agitation of the clippings between the deflecting faces and post and retain the clippings in a relatively loose state even though the nails should be dirty, and to accommodate ready disposal of the clippings upon opening of the clipper with the cutting edges facing a waste basket or the like and shaking the clipper toward the cutting edges of the leaf spring elements. The post extends through the leaf spring elements and is notched at its inner end portion to form a reaction member for an actuating lever. Decelerating faces cooperate with the post to confine the clippings to the region of the cutting edges of the clipper, and cause a circulation between the deflecting faces and cutting edges of the clipper. This also alerts the user to the accumulation of clippings, for disposal.

An advantage of the present invention is in the simplicity and efficiency of the cuttings decelerating and collecting element and the low cost of manufacture thereof.

A further advantage of the present invention is that the clippings are confined and circulated in a region close to the cutting edges of the clipper so a person clipping the nails may readily be aware of the clippings accumulated and dispose of the clippings prior to an excess accumulation thereof, and thereby increase the sanitary features of the nail clipper and prevent accidental discharge of the clippings to the floor.

Another advantage of the invention is in the simplicity of the clippings collector cooperating with the reaction post of the clipper and assuring the absence of scattering of the clippings beyond the sides of the clipper and thereby increasing the sanitary features of the clipper and efficiency in operation thereof.

A principal object of the invention, therefore, is to provide a simple improvement in nail clippers which confine the clippings to the region between the cutting elements and reaction post of the clipper for ready disposal, by separating the cutting edges of the clipper and shaking to one side or the other and toward the separated cutting edges of the clipper with the cutting edges facing downwardly.

A further object of the invention is to provide a simplified and improved form of clipper for the nails of the fingers or toes having deflecting and circulating faces cooperating with a recessed face on the post and forming a continuous face across the clipper and preventing an excess accumulation of clippings by alerting the person performing the clipping operation to any excess of clippings in the nail clipper.

The foregoing objects and advantages are obtained because the clippings are concentrated at the front of the clipper and the reaction post cooperates with the transversely extending deflecting and circulating faces to form a continuous channel at the front portion of said post and to thereby allow the clippings to be freely shaked out of the clipper.

These and other objects and advantages of the invention will appear from time to time as the following specification proceeds and with reference to the accompanying drawings wherein:

FIG. 1 is a side view of a nail clipper constructed in accordance with the principles of the present invention with the cutting edges of the flexible spring steel elements separated and in position to trim a nail and shown in vertical section along the center of the flexible spring steel elements to the proximate end thereof with a finger and nail of the person utilizing the clipper shown in phantom;

FIG. 2 is a fragmentary horizontal sectional view of the nail clipper and cuttings collector shown in FIG. 1 with the top spring steel element broken away adjacent the clippings collector and showing the balance of the top spring steel element in plan;

DESCRIPTION OF THE PREFERRED EMBODIMENT OF THE INVENTION

Figure 1:
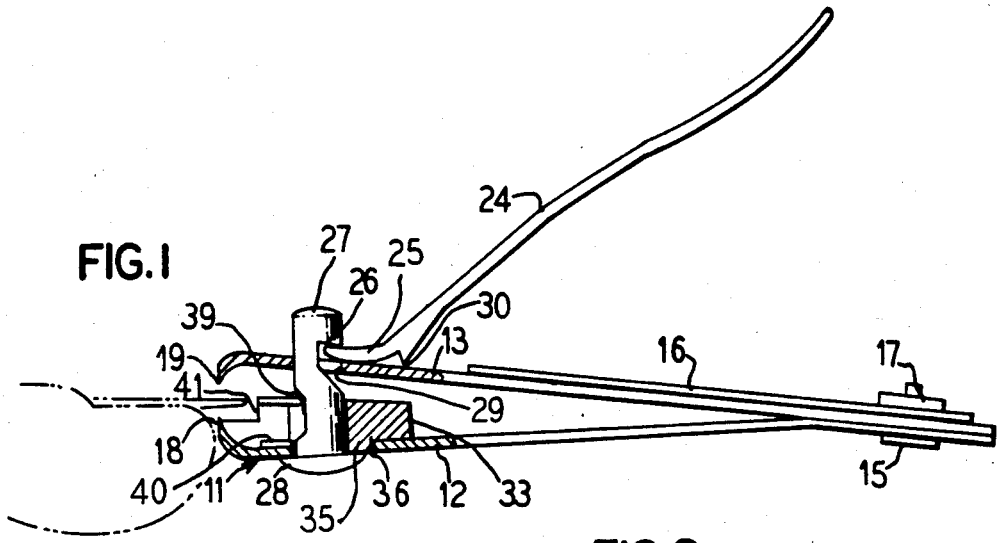
Figure 2:
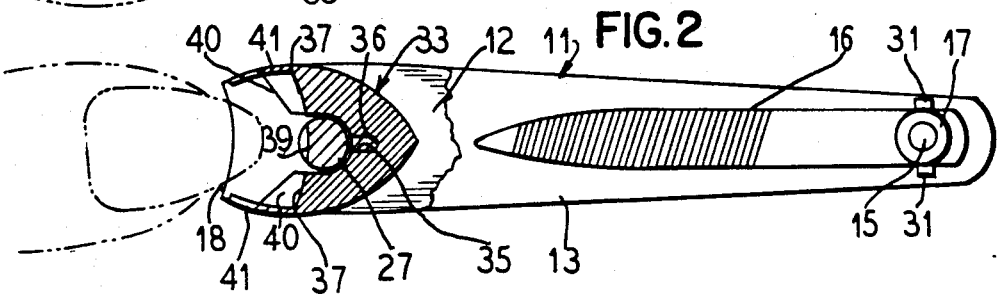

In the embodiment of the invention illustrated in FIGS. 1 and 2 of the drawings, I have shown a nail clipper 11 of a conventional form having a lower spring steel element 12 and an upper spring steel element 13 extending along the lower spring steel element 12. The spring steel elements 12 and 13 overlie one another and have distal ends riveted together by a rivet 15 extending through both of said elements, adjacent the distal ends thereof. The rivet 15 may form a mounting for a nail file 16 extending along the upper spring steel element, for use in filing the nails after a clipping operation thereof. The rivet 15 extends through the nail file and mounts the nail file to be pivotally moved about the axis of the rivet to extend to one side of the clipper, or along the upper spring steel element 13, and is retained thereto as by a washer 17 extending about the rivet 15 and suitably secured to said rivet in a manner known to the art so not herein shown or described further.

The spring steel elements 12 and 13 are normally biased away from each other at their proximate ends and may be held in their open position by the pressure of the washer 17 thereon. The lower spring steel element 12 has an upturned cutting edge 18 extending across said spring steel element 12 in an arcuate path and conforming to the correct contour of the clipped nail of the finger or toe.

The upper leaf spring element 13 has a corresponding cutting edge 19 conforming to and extending towards the cutting edge 18 and mating therewith during a nail trimming operation.

The leaf spring elements 12 and 13 are flexed to move together and effect a nail clipping operation by operation of an actuating lever 24 having a bifurcated end 25 extending within a downwardly facing notch 26 in a reaction pin 27. The reaction pin 27 has a head 28 engaging beneath the leaf spring element 12, and extends above the leaf spring element 13 through a slot 29 therein.

The actuating lever 24 has a heel 30 engaging the top surface of the leaf spring element 13, and reacts against the downwardly facing concave recessed portion of the reaction pin 27, and moves the two leaf spring elements 12 and 13 together to effect a clipping operation upon movement of the lever 24 in a direction, which in FIG. 1 is shown as being a clockwise direction.

Thus far the construction described is of a conventional form, similar to that shown in U.S. Pat. No. 4,380,120, so not described in further detail.

The actuating lever 24, like the actuating lever of the Hannon U.S. Pat. No. 4,380,120 can be placed in a stored condition along the top of the leaf spring element 12, between lugs 31 extending upwardly of opposite sides of the washer 17, by turning said actuating lever 24 and reaction pin 27 180° from the position shown in FIG. 1 over the nail file 16, and between the retainer lugs 31, as is conventional.

Figure 3:
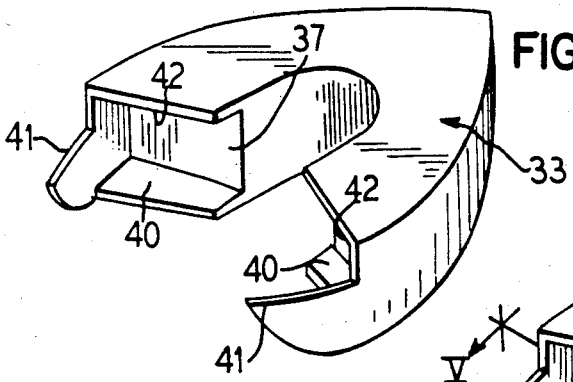
FIG. 3 is a perspective view of the clippings collector shown in FIGS. 1 and 2.

Referring now in particular to the decelerating and retaining means for the nail clippings shown in FIGS. 1, 2 and 3, a clippings decelerator and accumulator 33 extends transversely of the reaction pin 27, between the leaf spring elements 12 and 13, but beneath the bottom of the leaf spring element 13 a distance sufficient to allow said leaf spring element to effect a clipping operation in cooperation with the leaf spring element 12. The decelerator and accumulator 33 is shown in FIGS. 1, 2 and 3 as a solid member which may be molded from metal or plastic and has a depending key 35 fitting in a slot 36 in the leaf spring element 12. Said decelerator and accumulator also has decelerating faces 37 extending laterally from opposite sides of a recessed face 39 of the pin 27, and with said recessed face forms a channel like deceleration face extending across and between the leaf spring elements 12 and 13, and retaining the nail clippings to circulate and decelerate between the mating cutting edges 18 and 19 while confining the nail trimmings or clippings to the faces 37 of said decelerator and accumulator and the recessed face 39 of the pin 27 and to provide a free channel extending across the cutting decelerator and accumulator to enable the clippings to readily be shaked out of the clipper as desired.

The decelerator and accumulator 33 also has bottom ledges 40 extending along the top of the leaf spring element 12 toward the cutting edges 18 and 19 and has stepped side walls 41, extending in advance of the bottom ledges 40 which merge into the undersides of top ledges 42. The top ledges 42 extend over the decelerating faces 37 for a short distance and terminate into the stepped side wall 41 extending along opposite sides of the decelerator and accumulator to a position adjacent the cutting edge 18, to entirely close the space between the fulcrum pin 27 in cooperation with the arcuate face thereof to form a decelerator and accumulator channel for the nail clippings against which the clippings impinge for the width of the leaf spring element 12, and are collected for disposal by opening the two leaf spring elements 12 and 13 and shaking the clippings to pass out of the clipper to waste between the cutting edges 18 and 19.

Figure 4:
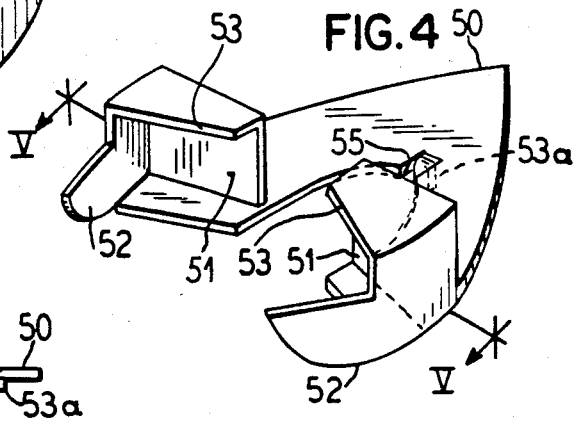
FIG. 4 is a perspective view of a modified form of clippings collector and accumulator which may be placed partially around the reaction post of the clipper and formed from sheet material.
Figure 5:
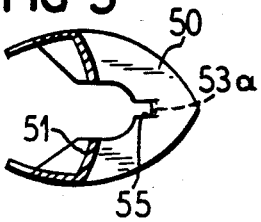
FIG. 5 is a sectional view taken substantially along line V—V of FIG. 4.
Figure 6:
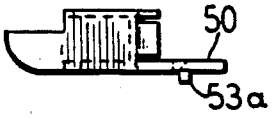
FIG. 6 is a view in side elevation of the clippings collector shown in FIGS. 4 and 5.

In the form of the invention illustrated in FIGS. 4, 5 and 6, the clippings decelerator and accumulator is like that shown in FIGS. 1, 2 and 3, but is formed from a flat plate 50 formed to extend about the side portions and rear portion of the reaction pin 27, and has a central open portion 55 extending partially about and towards the proximal ends of the flat spring steel elements 12 and 13. A tab 53*a* is bent from the longitudinal central portion of said plate to extend within the keying slot 36 of the spring steel element 12.

Decelerating faces 51 of the decelerator and accumulator may be bent upwardly from the plate 50 and may be of the same conformation as the faces 37 of the form of the invention illustrated in FIGS. 1 through 3. The faces 51 terminate at their outer sides and may be bent into side walls 52 extending along bottom plates formed from the plate 50 and therebeyond close to the cutting edges of the spring steel elements 12 and 13. The faces 51 form continuations of the recessed face 39 of the pin 27 and cooperate therewith to form a continuous channel extending across the spring steel elements 12 and 13 and project the clippings toward the cutting edges 18 and 19, and in effect cause a deceleration and circulation of clippings between the decelerating and accumulating faces 51 and the cutting edges 18 and 19 of the respective spring steel elements 12 and 13. The side walls 52 extend along opposite sides of the spring steel element 12, beneath upper ledges 53 and cooperate with the faces 51 and top ledges 53 extending from the tops of said side walls for a portion of the length thereof, and form channels on opposite sides of the reactor pin 27 to provide a continuous channel extending across the clippings decelerator and completed intermediate its ends by the arcuate face 39 of the reaction pin 27.

As shown in FIGS. 4 and 5, the plate 50 has a slot 55 punched from the center thereof to receive a pin or lug serving as a key to retain the decelerator and accumulator in the same general position as the decelerator and accumulator 33 shown in FIGS. 1 and 2.

The foregoing describes a simple decelerator and accumulator which may be stamped or otherwise formed from a single piece of sheet metal with a minimum of bending operations and may be welded or otherwise secured to the top face of the spring steel element 12 and which may accumulate the clippings in the region of the cutting edges 18 and 19 of the leaf spring elements 12 and 13 of the clipper.

It may be seen from the foregoing that I have devised a simplified form of decelerator and accumulator for the nail clippings of a nail clipper cooperating with a decelerating face 39 of the fulcrum pin 27 and preventing the flying of the clippings into the face or to the ground outside of the clipper in a simpler and more effective manner than the present-day nail clippers now on the market, and simplifying the construction of the decelerator and accumulator to the extent that it may be manufactured as an integral part of a nail clipper with a minimum amount of operations and at a lower cost than the nail clippers now on the market and having provisions for preventing the scattering of the nail clippings.

It further may be seen that a channel opening towards the cutting edges extends across the flexible steel elements 12 and 13 and is completed by the recessed face of the pin 27 to prevent flying of the clippings to one side or the other of the clipper, and retain the clippings between the cutting edges of the clipper and said channel, and prevent accidental discharge thereof to one side or the other of the clipper.

While I have herein shown and described one form in which my invention may be embodied, it should be understood that there may be numerous variations and modifications thereof without departing from the spirit and scope of the novel concepts of the invention.

I claim as my invention:

1. A clipper for the nails of the fingers and toes constructed to decelerate and confine the nail clippings for disposal to waste comprising first and second leaf spring elements in superimposed relation with respect to each other having proximate ends biased apart and having cooperating sharpened cutting edges inturned with respect to plane surfaces of said leaf spring elements and cooperating with each other to clip a nail along the cooperating cutting edges thereof, a reaction pin having a head abutting an underside surface of said first leaf spring element and extending through both of said elements and having a recessed portion above said second leaf spring element, a lever having a bifurcated end, the furcations of which are formed to extend within said recessed portion and react thereagainst, and having a fulcrum extending from the side thereof opposite the bifurcated portion reacting against said recessed portion and engageable with a top surface of said second leaf spring element to serve as a fulcrum and move said cutting edges together by flexing said second leaf spring element relative to said first leaf spring element to effect a nail clipping operation, said post also having a recessed surface facing said sharpened inturned cutting edges for opening to opposite sides of said post, and a clippings decelerator and accumulator on said first leaf spring element and extending partially about said post and opening toward said cutting edges and having plane faces on opposite sides of the recessed surface of said post and forming outward continuations thereof and also having side walls conforming to side walls of the proximate end of said first leaf spring element and confining the clippings to the space between said post and said cutting edges for discharge to waste upon opening of said clipper and the shaking of the clipper from side to side with the cutting edges thereof facing downwardly.

2. The nail clipper of claim 1 in which the nail clipping decelerator and accumulator has a bottom wall engaging the lowermost of said leaf spring elements, and a key depending from said bottom wall to retain the clippings decelerator and accumulator in position about said post.

3. The nail clipper of claim 1, in which the clipping decelerator and accumulator has bottom and top ledges defining channels extending outwardly of said recessed surface of said post and having plane arcuate faces extending from opposite sides of said post, and wherein said top and bottom ledges are connected together along each side of said first leaf spring element by side walls generally conforming to the sides of said leaf spring elements as they approach the cutting edges thereof.

4. The nail clipper of claim 3 in which the cuttings decelerator and accumulator is molded and secured in position about said post by a key.

5. The nail clipper of claim 1 in which the cuttings accumulator and decelerator is made from a single piece of sheet metal by a succession of stamping, bending and welding operations.

6. The clippings decelerator and accumulator of claim 5 wherein said flat piece of sheet metal has a key bent from said flat piece along the longitudinal center thereof and serving to key said clippings decelerator and accumulator in position on the lowermost of said leaf spring elements.

7. The nail clipper of claim 1 in which the nail clipping decelerator and accumulator is formed from a flat piece of sheet metal extending partially about said post and having clippings retainer walls in the form of an upright piece bent from said piece of sheet metal, and having an upper roof member bent therefrom toward said cutting edges and extending from the recessed surface of said post and forming lateral continuations thereof.

8. The cuttings decelerator and accumulator of claim 7 in which the flat piece of sheet metal is adhesively secured to the top surface of the lowermost of said leaf spring elements.

9. The nail clipping decelerator and accumulator of claim 7 in which the piece of sheet metal thereof is welded to the top surface of the lowermost of said leaf spring elements.

10. A clipper for the nails of the fingers and toes constructed to decelerate and confine the nail clippings for disposal to waste comprising lowermost and uppermost leaf spring elements in superimposed relation with respect to each other having proximate ends biased apart and having cooperating sharpened cutting edges inturned with respect to plane surfaces of said leaf spring elements and cooperating with each other to clip a nail along the cooperating cutting edges thereof, a reaction pin having a head abutting the underside of the lowermost of said leaf spring elements and extending through both of said elements and having a recessed portion above the upper most of said leaf spring elements, a lever having a bifurcated end, the furcations of which are formed to extend within said recessed portion and react thereagainst, and having a fulcrum extending from the side thereof opposite the bifurcated portion reacting against said recessed portion and engageable with a top surface of the uppermost leaf spring element to serve as a fulcrum and move said cutting edges together by flexing the uppermost leaf spring element relative to the lowermost leaf spring element to effect a nail clipping operation, said post also having a recessed surface facing said sharpened inturned cutting edges and opening to opposite sides of said post, and a clipping decelarator and accumulator on the lowermost of said leaf spring elements and extending partially about said post and opening toward said cutting edges and having plane faces extending from opposite sides of the recessed surface of said post and forming laterally outward continuations of said recessed surface of said post.

11. A clipper for the nails of the fingers and toes constructed to decelerate and confine the nail clippings for disposal to waste comprising first and second leaf spring elements in superimposed relation with respect to each other having proximate ends biased apart and having cooperating arcuate sharpened cutting edges which are inturned with respect to plane surfaces of said leaf spring elements and cooperating with each other to clip a nail along the cooperating arcuate cutting edges thereof, a reaction pin having a head abutting an underside surface of said first leaf spring element and extending through both of said elements and having a recessed portion extending above a top surface of said second leaf spring element and facing distal ends of said elements, a lever having a bifurcated end, the furcations of which are formed to extend within said recessed portion and react thereagainst, and having a fulcrum reacting against said recessed portion and engageable with the top surface of the second leaf spring element to move said cutting edges together by flexing the second leaf spring element relative to the first leaf spring element to effect a nail clipping operation, and a clippings decelerator and accumulator on said first leaf spring element having arcuate deflecting faces spaced from and generally conforming to said arcuate cutting edges, and said pin having an arcuate formed surface to cooperate with said deflecting faces to form a continuous arcuate channel extending transversely across a forward postion of said first leaf spring element.

12. A clipper for nails of the fingers and toes having first and second leaf spring elements arranged in superimposed relation with proximate ends biased apart and each of said elements having a cooperating arcuate sharpened cutting edge which are inturned toward one another to clip a nail along the cooperating arcuate cutting edges thereof, each said inturned arcuate cutting edges having a back surface, a reaction pin having a head abutting an underside of said first leaf spring element and extending through both of said elements and having a recessed portion extending above a top surface of said second leaf spring element, a lever having a bifurcated end and cooperating with the recessed portion of said reaction pin to move said arcuate cutting edges together by flexing the second leaf spring element relative to the first leaf spring element to effect a nail clipping operation wherein the improvement comprises:

a clippings decelerator carried on said first leaf spring element and having an arcuate deflecting face spaced from and generally conforming to said arcuate cutting edges which together with said back surfaces of said arcuate cutting edges form a continuous arcuate channel extending transversely across a forward portion of said first leaf spring element; and an accumulator means including a pair of spaced side walls extending forward of said arcuate deflecting face and generally conforming to side edges of said leaf spring elements, whereby said arcuate deflecting face deflects nail clipping forward toward the back surfaces of the arcuate cutting edges to entrap the clippings in the area of said arcuate channel.

* * * * *